United States Patent [19]

Gilvar et al.

[11] 4,413,494

[45] Nov. 8, 1983

[54] PINCH ROLL SYSTEM FOR VERTICAL LAYING HEADS

[75] Inventors: Martin Gilvar, Oakham; Philips Wykes, Worcester, both of Mass.

[73] Assignee: Morgan Construction Company, Mass.

[21] Appl. No.: 234,115

[22] Filed: Feb. 13, 1981

[51] Int. Cl.[3] ..... B21D 7/08

[52] U.S. Cl. ..... 72/167; 72/240; 72/366

[58] Field of Search ..... 72/166–174, 72/366, 14, 240

[56] References Cited

U.S. PATENT DOCUMENTS

| | | | |
|---|---|---|---|
| 2,179,011 | 11/1939 | Hudson | 72/169 |
| 2,190,429 | 2/1940 | Kellogg | 72/167 |
| 2,231,400 | 2/1941 | Washburn et al. | 72/169 |
| 2,245,407 | 6/1941 | Lignian | 72/166 |
| 2,653,496 | 9/1953 | Anderson | 72/168 |
| 3,036,622 | 5/1962 | Hitz | 72/170 |
| 3,842,473 | 10/1974 | Couper | 72/166 |
| 4,215,558 | 8/1980 | Shiguma et al. | 72/240 |
| 4,290,288 | 9/1981 | Kawakubo et al. | 72/240 |
| 4,344,309 | 8/1982 | Matsuzaki | 72/366 |

*Primary Examiner*—Daniel C. Crane

*Attorney, Agent, or Firm*—Thompson, Birch

[57] ABSTRACT

In a rolling mill wherein hot rolled rod is directed along a downwardly curved path into a vertical laying head which forms the rod into a series of rings, a method of and apparatus for propelling the rod through the laying head. The rod is passed between a pair of adjustable driven pinch rolls located in advance of the downwardly curved path. An initial closing force is exerted on the pinch rolls to establish an initial parting prior to entry of a rod front end therebetween. The initial parting is sized to produce at least some rod deformation while providing a driving relationship between the pinch rolls and the rod. The initial closing force is greater than the momentary surge in separating force accompanying impact of a rod front end with the pinch rolls. The initial parting is maintained until the rod front end has negotiated the downwardly curved path and has passed through the laying head, at which time the initial closing force is released. The pinch rolls can then either be opened completely to allow the rod to continue running freely therebetween, or the initial closing force can be replaced by a lower secondary closing force which allows the rod to push the pinch rolls apart to a secondary parting. The second parting continues the driving relationship between the pinch rolls and the rod, without any accompanying rod deformation.

10 Claims, 7 Drawing Figures

PINCH ROLL SYSTEM FOR VERTICAL LAYING HEADS

BACKGROUND OF THE INVENTION

This invention relates to steel rod rolling mills of the type where hot rolled rod is directed from the last mill stand through water cooling boxes to a laying head which forms the rod into a series of rings. The rings are collected on a moving conveyor in a non-concentric overlapping pattern where they are subjected to further controlled cooling to obtain desired metallurgical properties.

As illustrated in U.S. Pat. No. 3,469,798, the laying heads can be either of the vertical, horizontal or inclined type. Although vertical laying heads provide a more consistent ring pattern on the conveyor, they suffer from the disadvantage of requiring traction devices to direct the rod along a downwardly curved path from horizontal to vertical. Examples of such traction devices include chain guides of the type shown in U.S. Pat. No. 3,100,070 and wheel guides of the type shown in U.S. Pat. No. 3,777,964. These traction devices are mechanically complex, and as such are difficult and costly to maintain, particularly under the demanding conditions which prevail in modern mills, where the rod is being delivered at speeds exceeding 70 meters/sec. and at temperatures in the range of 780°–1000° C.

In the past, there have been occasions where after the rod has been turned downwardly, pinch rolls have been employed to drive the rod tail ends through vertical laying heads. Some thought has been given to substituting similar pinch roll arrangements for the conventional traction devices used in advance of the vertical laying heads. However, those skilled in the art have felt constrained from making this substitution because of a belief that pinch rolls cannot be relied on to supply an uninterrupted driving force at the critical time when the rod front end is negotiating the curved path from horizontal to vertical. The basis for this belief is that if the pinch rolls are opened to accommodate an easier entry of the rod front end, then there will be insufficient time available to re-establish a steady-state roll nip before the front end encounters the resistance of the downward bend into the laying head. Alternatively, if the pinch rolls are closed to their normal operating setting prior to the front end coming through, then the impact of rod entry will force the rolls to jump apart momentarily, thus again making it doubtful that a steady-state nip can be re-established in time to drive the rod front end downwardly into the laying head. The present invention provides a different method and apparatus for employing pinch rolls which avoids these difficulties, thereby making it possible to do away with the more complex traction devices conventionally employed to drive rod along downwardly curved paths into vertical laying heads.

SUMMARY OF THE INVENTION

The method and apparatus of the present invention utilizes a pair of horizontally arranged driven pinch rolls in advance of a curved guide path leading downwardly into a vertical laying head. A high initial closing force is exerted to hold the pinch rolls at an initial parting which is sized to produce at least some rod deformation. The initial closing force is greater than the momentary surge in separating force accompanying impact of the rod front end during entry, with the rod deformation being similar to that occurring in a rolling mill stand taking a light reduction. This insures that entry of the rod front end between the pinch rolls will not interrupt the forward driving force being imparted to the rod. The high initial closing force is released as soon as the rod front end has been driven downwardly through the laying head. Thereafter, the pinch rolls can be opened completely to allow the rod to continue running freely therebetween. Preferably, however, the high initial closing force is replaced by a lower secondary closing force. This lower force allows the rod to push the pinch rolls apart to a secondary parting which eliminates the aforesaid rod deformation while continuing to propel the rod through the laying head.

Those skilled in the art will appreciate that because the leading end section of each rod is already off-gauge as a result to the rolling operation, and thus subject to eventual trimming and scrapping, the deformation imparted by the initial pinch roll setting does not have any detrimental effect on the overall efficiency of the mill.

DESCRIPTION OF PREFERRED EMBODIMENT

Figure 1:
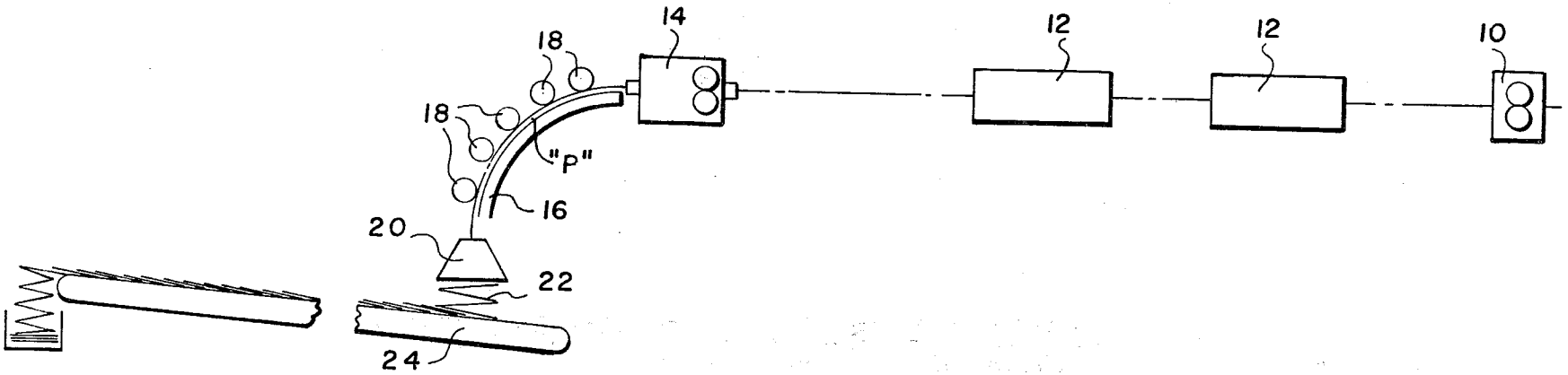
FIG. 1 is a schematic view in side elevation of the delivery end of a rod mill employing driven pinch rolls in accordance with the present invention.
Figure 2:
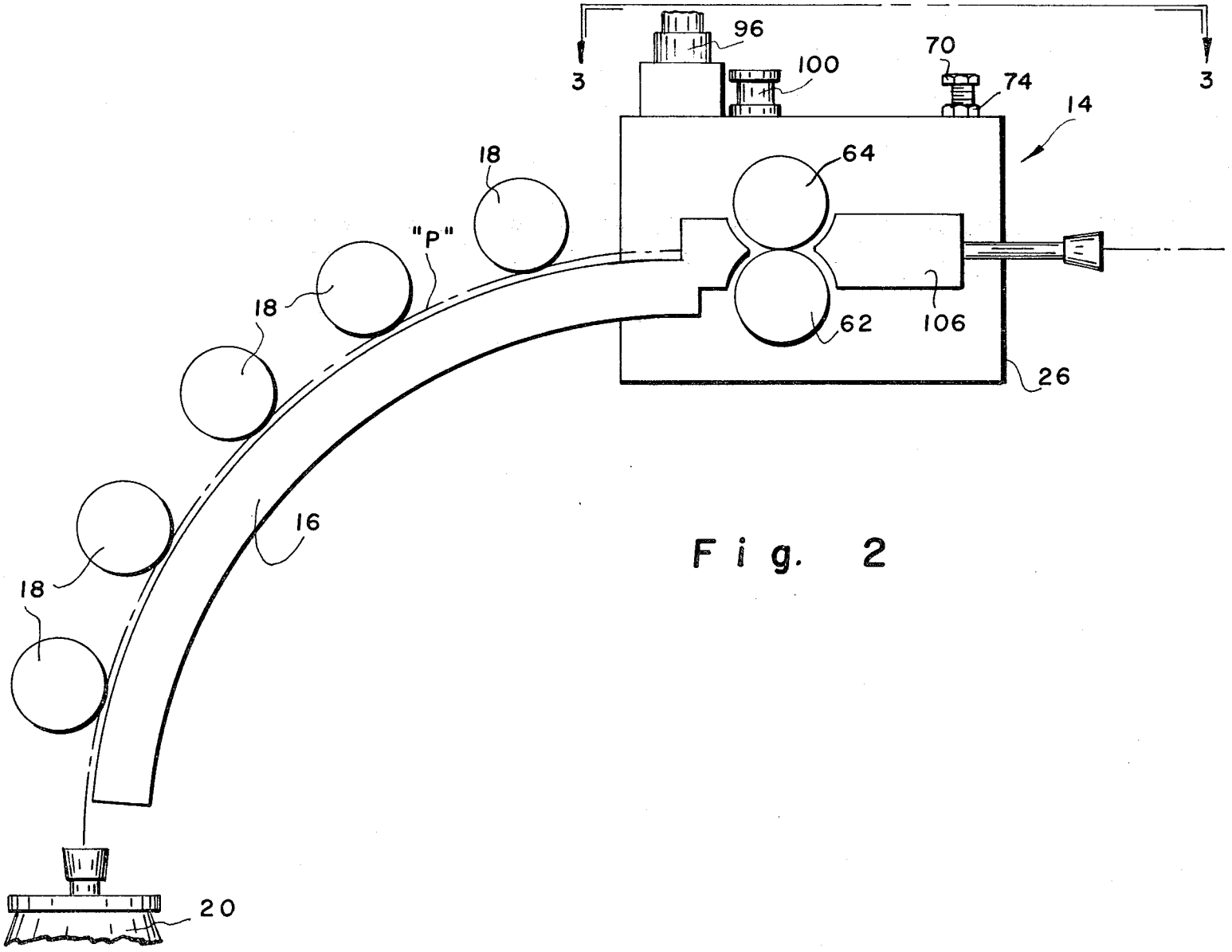
FIG. 2 is an enlarged side elevational view of the pinch roll unit.
Figure 3:
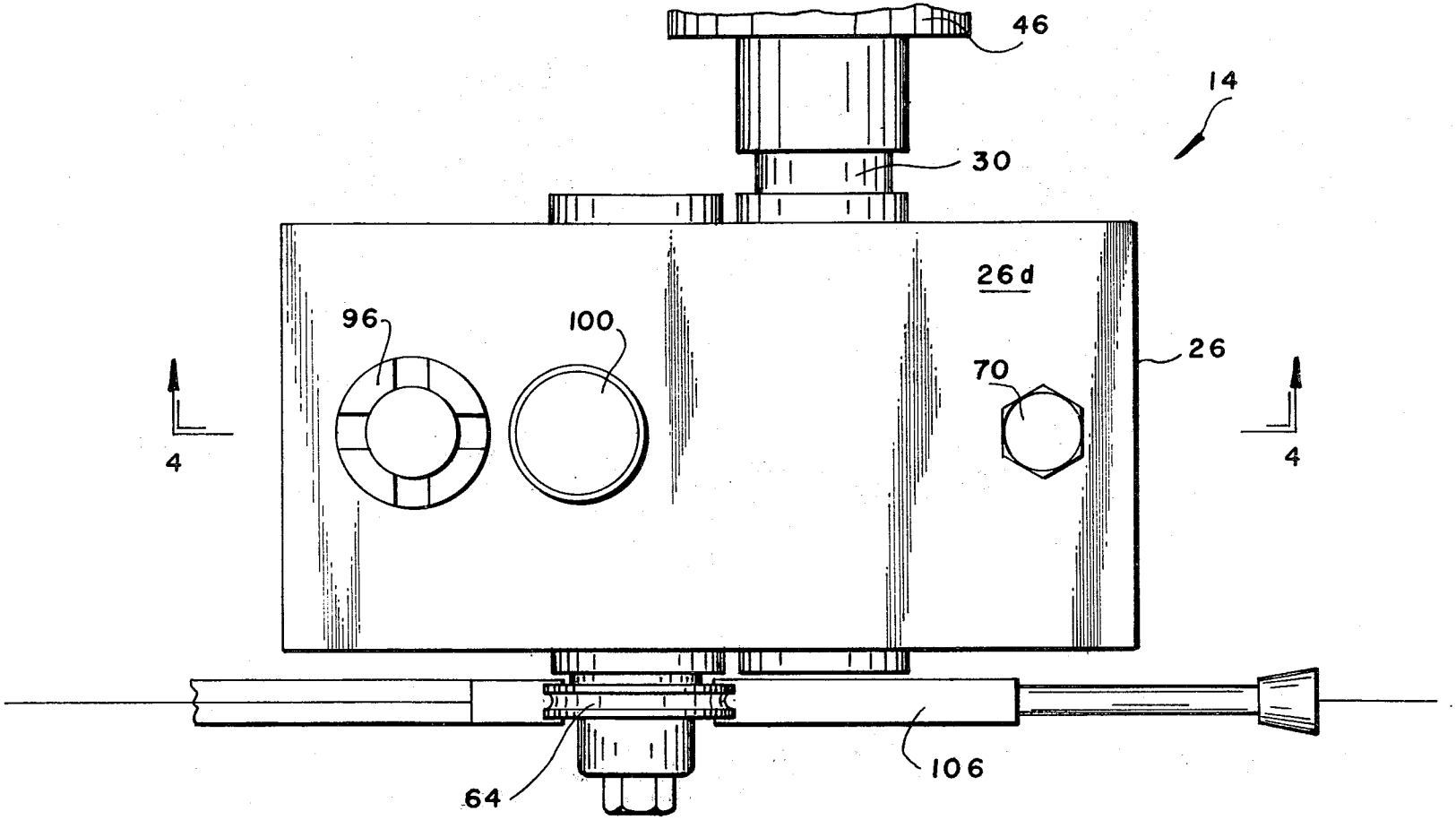
FIG. 3 is a top plan view of the pinch roll unit.
Figure 4:
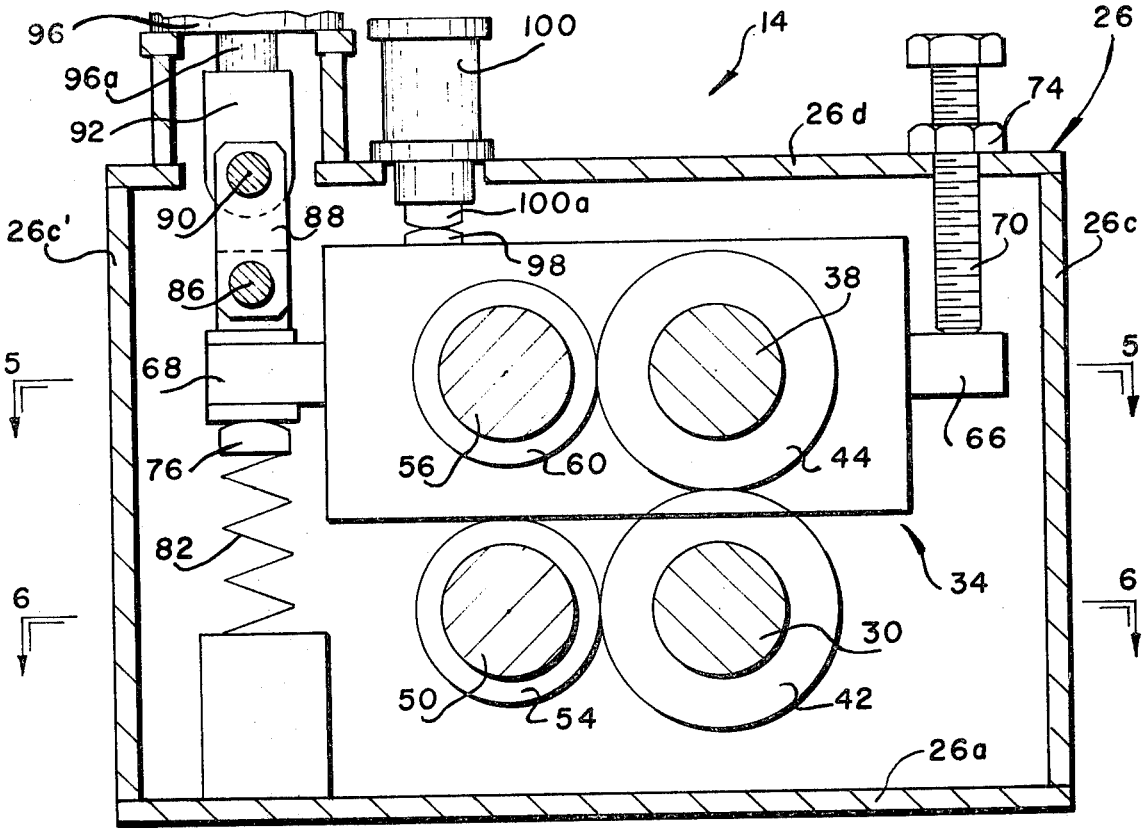
FIG. 4 is a vertical sectional view taken through the pinch roll unit on line 4—4 of FIG. 3.

Referring initially to FIG. 1, the last mill stand of a rolling mill finishing train is indicated at 10. Hot rolled rod emerging from mill stand 10 is directed substantially horizontally through a series of conventional water boxes 12 and then on through a pinch roll unit 14 in accordance with the present invention. The pinch roll unit is positioned immediately upstream from a downwardly curved path "P" defined by a curved closed pipe, or preferably by a curved open-sided guide pipe 16 and a plurality of freely rotatable guide rollers indicated typically at 18. After negotiating the downwardly curved path P, the rod enters a conventional laying head 20 which forms the rod into a series of rings 22. The rings are received on an underlying conveyor 24 where they are arranged in an offset overlapping pattern. While on the conveyor, the rod rings are subjected to additional controlled cooling to achieve desired metallurgical properties. Once this has been accomplished, the rings are removed from the delivery end of the conveyor and accumulated into coils. With the exception of the pinch roll unit 14, the foregoing represents conventional practice now well known to those skilled in the art.

Referring now to FIGS. 2–6, the pinch roll unit 14 includes a fixed housing structure 26 having a bottom plate **26*a*, side walls 26*b*, 26*b*' and end walls 26*c*, 26*c*'. The top of the housing is closed by a top plate 26*d***.

Figure 5:
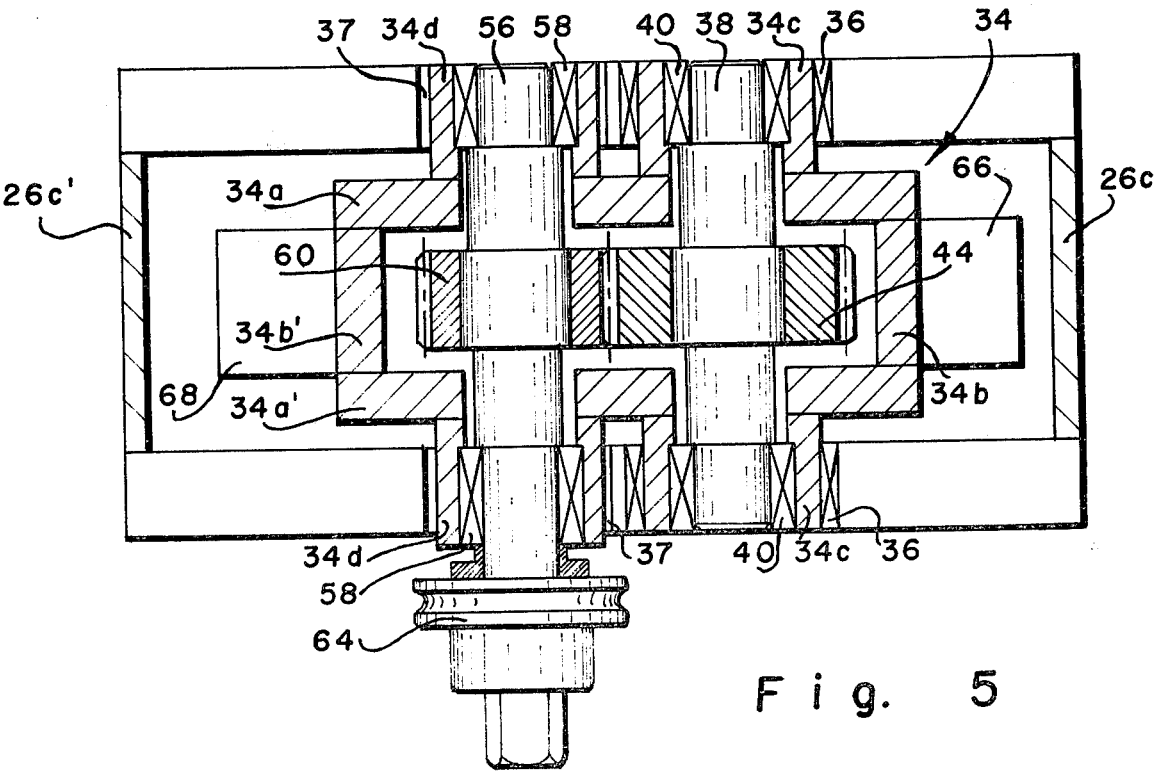
FIGS. 5 and 6 are horizontal sectional views of the pinch roll unit taken respectively along lines 5—5 and 6—6 of FIG. 2; and, FIG. 7 is an enlarged cross section of a typical rod front end after it has been passed through the pinch roll unit, with the deformation imparted as a result of the initial pinch roll setting being exaggerated for purposes of illustration.
Figure 6:
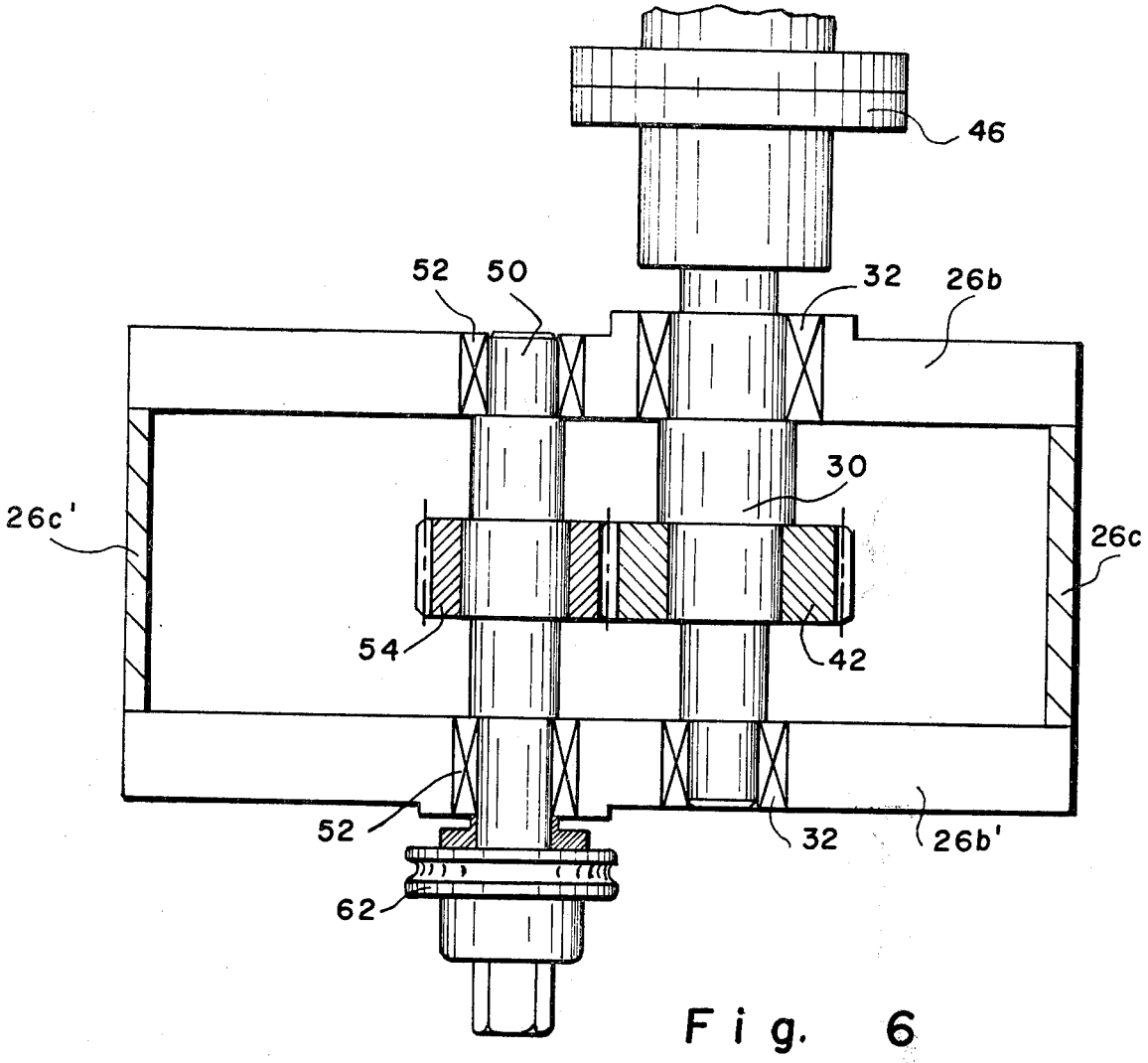

A lower gear shaft 30 is journalled for rotation on a fixed axis between bearings 32 which are carried by the housing side walls 26*b*, 26*b*'. An inner housing 34 is contained within the stationary housing structure 26. As shown in FIG. 5, the inner housing includes side plates 34*a*, 34*a*' joined by end plates 34*b*, 34*b*'. The side plates 34*a*, 34*a*' have laterally protruding sleeves 34*c* and 34*d*. The sleeves 34*c* are pivotally journalled in bearings 36 carried by the housing side walls 26*b*, 26*b*', whereas the sleeves 34*d* are movable freely in openings 37 in the housing side walls. An upper gear shaft 38 is journalled for rotation between bearings 40 contained in the sleeves 34*c*. The rotational axis of upper gear shaft 38 and the pivotal axis of housing 34 as defined by sleeves 34*c* are coincident and parallel to the rotational axis of the lower gear shaft 30. The gear shafts 30, 38 carry intermeshed gears 42, 44 and the lower gear shaft 30 protrudes through housing side wall 26*b* where it is connected by a coupling 46 to a conventional drive (not shown).

A lower roll shaft 50 is journalled for rotation on a fixed axis between bearings 52 carried by the housing side walls 26*b*, 26*b*'. Lower roll shaft 50 carries a gear 54 in meshed relationship with gear 42 on lower gear shaft 30.

An upper roll shaft 56 is rotatably journalled between bearings 58 carried in the sleeves 34*d* of inner housing 34. The upper roll shaft 56 carries a gear 60 which is in meshed relationship with gear 44 on upper gear shaft 38. The roll shafts 50, 56 protrude beyond housing side wall 26*b*' and have grooved pinch rolls 62, 64 mounted in cantilever fashion thereon.

The inner housing 34 has ears 66, 68 extending respectively in forward and rearward directions from its end plates 34*b*, 34*b*'. The forward ear 66 is arranged to contact an adjustable stop in the form of a heavy duty bolt 70. The bolt 70 is threaded through the housing top plate 26*b* and is held at any selected setting by means of a lock nut 74.

The rearward ear 68 is arranged to contact a spherical cap 76 which is urged upwardly by a helical spring 82. Ear 68 is connected as at 86 to intermediate links 88 which are in turn connected as at 90 to a cross bar on the piston rod 96*a* of a pneumatic cylinder 96. Inner housing 34 is additionally provided with an upstanding nose 98 arranged to be contracted by the ram 100*a* of a heavy duty hydraulic cylinder 100.

With this arrangement, the lower pinch roll 62 remains fixed, and roll parting is changed by pivotally adjusting the inner housing 34 about the axis of upper gear shaft 38. Throughout such adjustments, the 4-gear cluster consisting of gears 42, 44, 54, 56 provides an uninterrupted drive connection for the pinch rolls.

Figure 7:
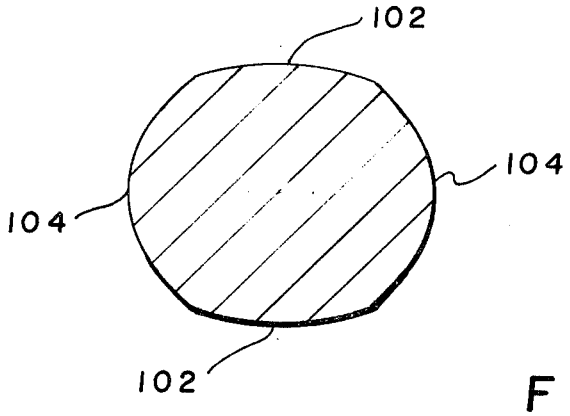

The method of operating the pinch roll unit 14 in accordance with the present invention is as follows: before the leading end of a rod is received at the pinch roll unit, the bolt 70 is adjusted in relation to the forwardly extending ear 66 to achieve an initial parting between the pinch rolls 62, 64 and the hydraulic ram 100 is actuated to exert an initial closing force which pivots the inner housing 34 in a counterclockwise direction, thereby firmly holding the ear 66 against the lower end of the bolt 70. This initial closing force, which easily overcomes the opposing force of spring 82, is greater than the momentary surge in separating force to which the pinch rolls will be subjected when the rod front end enters the pinch roll gap. The initial pinch roll parting is sized to impart some deformation to the rod passing therebetween. As shown in FIG. 7, this deformation will consist of a slight flattening at the top and bottom of the rod as at 102 with accompanying slight bulges at the sides as at 104. This type of deformation is similar to that occuring in a mill stand taking a light reduction.

A conventional mill guide 106 is provided to direct the leading end of an oncoming rod between the pinch rolls 62, 64. The initial roll parting is determined by the adjustment of bolt 70 and the high initial level of closing force exerted by the hydraulic ram 100 insures that the pinch roll nip will remain in a steady-state condition during rod entry, thereby providing an uninterrupted driving force which propels the rod around the downwardly curved path P and through the laying head 20. After the rod has passed through the laying head (typically after the first one or two rings have been laid on the conveyor 24), the hydraulic ram 100 is deactivated. This can be accomplished by any conventional control arrangement, such as for example by sensing the increased load on the pinch roll drive at the time of rod entry and by employing a pulse counter to emit a signal to a solenoid controlling the hydraulic ram after a selected time delay. As soon as the hydraulic ram is deactivated, the high initial closing force is released. When this occurs, the separating force exerted on the pinch rolls by the rod passing therebetween pivots the inner housing 34 in a clockwise direction against a lower secondary closing force supplied by the pneumatic cylinder 96. The secondary closing force is adequate to maintain a secondary parting between the pinch rolls which eliminates the aforesaid rod deformation while continuing to propel the rod along curved path P and through the laying head. This condition is maintained until the tail end of the rod has passed through the pinch roll unit. Alternatively, the pneumatic cylinder 96 can be set to allow the rod to run freely between the pinch rolls after deactivation of the hydraulic ram 100. Once a rod has passed through the pinch roll unit, the hydraulic ram is again activated to reset the pinch rolls to their initial parting in preparation for receipt of the next rod front end.

We claim:

1. In a rolling mill wherein hot rolled rod is directed along a downwardly curved path into a vertical laying head which forms the rod into a series of rings, a method of propelling the rod along said path and through the laying head comprising:

directing the rod between a pair of driven pinch rolls located in advance of said path, said pinch rolls having means associated therewith for accommodating roll parting adjustments, exerting an initial closing force on said pinch rolls to establish an initial parting prior to entry of a rod front end therebetween, said initial parting being sized to produce at least some rod deformation while providing a driving relationship between said pinch rolls and said rod, said initial closing force being greater than the momentary surge in separating force accompanying impact of a rod front end with said pinch rolls;

maintaining said initial closing force and said initial parting until the rod front end has passed along said path through the laying head, and thereafter releasing said initial closing force to allow said rod to force said pinch rolls apart to a secondary parting at which said rod deformation is eliminated while said driving relationship continues to be maintained.

2. The method of claim 1 wherein the pinch rolls are held at said secondary parting by a secondary closing force which is lower than said initial closing force.

3. The method of claim 2 wherein said initial closing force is hydraulically maintained, and wherein said lower secondary closing force is pneumatically maintained.

4. The method in accordance with either of claims 1, 2 or 3 wherein adjustment of the roll parting between said initial and secondary parting is achieved by pivotally adjusting one pinch roll relative to the other pinch roll.

5. In a rolling mill wherein hot rolled rod continues substantially horizontally from the last mill stand and then downwardly along a curved path into a vertical laying head which forms the rod into a series of rings, a method of propelling the rod along said path and into the laying head by employing a pair of driven pinch rolls located in advance of said curved path, said pinch rolls having means associated therewith for accommodating roll parting adjustments in response to changes in a closing force to which the pinch rolls are subjected, said method comprising the steps of:

directing the rod between said pinch rolls;

increasing the closing force to a high initial level to achieve a reduced initial roll parting prior to entry of a rod front end therebetween, said initial parting being sized to produce at least some rod deformation, and said initial high level of closing force being greater than the increased level of separating forces occasioned by impact of the rod front end with the pinch rolls during entry, maintaining said initial high level of closing force and said initial parting until the rod front end has negotiated said curved path and has passed through said laying head, and thereafter decreasing the closing force to a lower secondary level which allows the rod to force said pinch rolls apart to a secondary parting which eliminates said rod deformation while continuing to maintain a driving relationship between said pinch rolls and the rod passing therebetween.

6. In a rolling mill wherein hot rolled rod continues sustantially horizontally from the last mill stand and then downwardly along a curved path into a vertical laying head which forms the rod into a series of rings, apparatus for propelling the rod along said path and into said laying head, comprising:

a pair of driven pinch rolls located in advance of said path, mounting means associated with the pinch rolls for accommodating roll parting adjustments, first closure means for exterting an initial closing force on said mounting means to establish an initial parting between said pinch rolls prior to entry of a rod front end therebetween, said initial parting being sized to produce at least some rod deformation while providing a driving relationship between said pinch rolls and said rod, said initial closing force being greater than the momentary surge in separating forces accompanying impact of a rod front end with said pinch rolls, means for maintaining said initial closing force and said initial parting until the rod front end has negotiated said curved path and has passed through said laying head, and second closure means operable upon release of said first closure means for exerting a lower secondary closing force on said mounting means in place of said initial closing force, said secondary closing force being such as to permit the rod to push said pinch rolls apart to a secondary parting which eliminates said rod deformation while continuing to maintain said driving relationship.

7. The apparatus of claim 6 wherein said mounting means comprises a housing structure supporting one pinch roll for rotation about a fixed axis, and a lever supporting the other pinch roll for pivotal adjustment relative to the said first-mentioned pinch roll.

8. The apparatus of claim 7 further comprising an adjustable stop on said housing structure against which said lever is held by said first closure means.

9. The apparatus according to either of claims 6, 7 or 8 wherein said first closure means comprises a hydraulic linear actuator.

10. The apparatus according to either of claims 6, 7 or 8 wherein said second closure means comprises a pneumatic linear actuator.

* * * * *